US009587457B2

(12) United States Patent
Corre et al.

(10) Patent No.: US 9,587,457 B2
(45) Date of Patent: Mar. 7, 2017

(54) SYSTEM AND METHOD FOR ENHANCING PACKER OPERATION AND LONGEVITY

(71) Applicant: Schlumberger Technology Corporation, Sugar Land, TX (US)

(72) Inventors: Pierre-Yves Corre, Eu (FR); Gilles Carree, Regniere-Ecluse (FR); Stephane Metayer, Abbeville (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 947 days.

(21) Appl. No.: 13/858,622

(22) Filed: Apr. 8, 2013

(65) Prior Publication Data

US 2013/0228279 A1 Sep. 5, 2013

Related U.S. Application Data

(62) Division of application No. 12/466,497, filed on May 15, 2009, now Pat. No. 8,413,717.

(51) Int. Cl.
*E21B 33/12* (2006.01)
*E21B 33/127* (2006.01)

(52) U.S. Cl.
CPC ..... *E21B 33/1216* (2013.01); *E21B 33/1208* (2013.01); *E21B 33/1277* (2013.01)

(58) Field of Classification Search
CPC ..... E21B 33/1208; E21B 33/1216; E21B 33/1277
See application file for complete search history.

(56) References Cited

U.S. PATENT DOCUMENTS

| | | | |
|---|---|---|---|
| 2,258,674 | A | 10/1941 | Ceska |
| 2,275,086 | A | 3/1942 | Otterbourg |
| 2,643,722 | A | 6/1953 | Lynes et al. |
| 3,529,667 | A | 9/1970 | Malone |
| 3,581,816 | A | 6/1971 | Malone |
| 4,310,161 | A | 1/1982 | Streich |
| 4,467,835 | A | 8/1984 | Champleboux |
| 4,467,836 | A | 8/1984 | Ragout |
| 5,205,567 | A | 4/1993 | Quinlan et al. |
| 5,340,626 | A | 8/1994 | Head |
| 5,778,982 | A | 7/1998 | Hauck et al. |
| 6,431,275 | B1 | 8/2002 | Turley |
| 6,752,205 | B2 | 6/2004 | Kutac et al. |
| 7,017,881 | B2 | 3/2006 | Ward |
| 2002/0195244 | A1 | 12/2002 | Coronado et al. |

(Continued)

FOREIGN PATENT DOCUMENTS

| | | | |
|---|---|---|---|
| EP | 1780373 | A1 | 5/2007 |
| GB | 2262553 | A | 6/1993 |

OTHER PUBLICATIONS

European Search Report issued in European Application No. 10774612.5 on Mar. 31, 2014; 7 pages.

*Primary Examiner* — James Sanders
(74) *Attorney, Agent, or Firm* — Trevor G. Grove

(57) ABSTRACT

A technique improves the formation of dependable seals along wellbores. A packer is constructed with a plurality of elastomeric layers and an internal mechanical layer that extend between mechanical extremities. One or more of a variety of features can be added to, or used in conjunction with, the packer to reduce wear and the potential for detrimental damage during use of the packer.

9 Claims, 6 Drawing Sheets

(56) References Cited

U.S. PATENT DOCUMENTS

| | | | | |
|---|---|---|---|---|
| 2004/0216871 | A1 | 11/2004 | Mendez et al. | |
| 2006/0219400 | A1 | 10/2006 | Xu et al. | |
| 2007/0089877 | A1* | 4/2007 | Corre | E21B 33/1277 166/187 |
| 2007/0142547 | A1 | 6/2007 | Vaidya et al. | |
| 2007/0193736 | A1 | 8/2007 | Corre et al. | |
| 2007/0227724 | A1 | 10/2007 | Saltel | |
| 2007/0261847 | A1 | 11/2007 | Saltel | |
| 2007/0289735 | A1 | 12/2007 | Corre et al. | |
| 2010/0122821 | A1 | 5/2010 | Corre et al. | |

* cited by examiner

SYSTEM AND METHOD FOR ENHANCING PACKER OPERATION AND LONGEVITY

BACKGROUND

A variety of packers are used in wellbores to isolate specific wellbore regions. A packer is delivered downhole on a conveyance and expanded against the surrounding wellbore wall to isolate a region of the wellbore. Once set against the surrounding wellbore wall, the packer can be subjected to substantial heat, pressures and forces. Consequently, the packer may experience wear that increases the likelihood of packer failure.

The packer may be designed with metal cables extending between packer extremities, such as mechanical end fittings. The metal cables are surrounded with a rubber material that expands when the packer is expanded. During expansion, the spacing between each cable is increased and the rubber thickness is decreased. Under high differential pressures, high packer inflation pressures, and/or high temperatures, the rubber material can become viscous and creep. The movement of the rubber material may result in contact between cable layers and/or contact between cables and portions of the packer extremities. The contact between cables and the significant tension placed on the cables can lead to cable deterioration and breakage, ultimately ending in packer destruction. The damage often occurs at contact points between cables and an outer skirt of the packer extremity and/or at contact points between adjacent cables, often in proximity to one or both packer extremities. The cables tend to break at the side of the packer experiencing higher pressure differentials.

Packers also can experience undue wear and potential failure due to the presence of voids in the packer structure. The presence of voids potentially leads to detrimental collapse of the rubber material and/or friction between packer components during packer expansion. Additionally, the outer rubber layer of packers is susceptible to breakage at locations experiencing high axial pressure differentials. Breakage of the outer rubber layer typically occurs near the low-pressure end of the packer. Once breakage occurs, the broken rubber creates difficulties in extracting the packer. Also, breakage of the outer rubber layer tends to leave a gap between the packer and the wellbore, and the rubber material tends to expand to fill this gap. Consequently, as the packer expands, components of the mechanical structure, e.g. steel cables and anti-extrusion layers, can contact each other and create friction that leads to further damage of the packer.

SUMMARY

In general, the present invention provides a system and method for forming dependable seals along wellbores. A packer is constructed with a plurality of elastomeric layers and an internal mechanical layer that extend between mechanical extremities. One or more protective features is added to, or used in conjunction with, the packer to reduce wear and the potential for detrimental damage during use of the packer.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
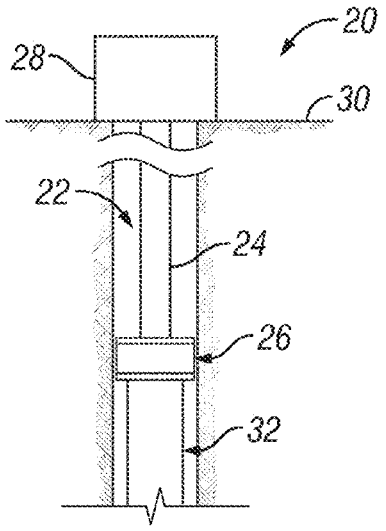
FIG. 1 is a schematic front elevation view of a well system having a packer and completion deployed in a wellbore, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for forming seals along wellbores by providing a packer resistant to wear and degradation in a downhole environment. The packer generally comprises a plurality of elastomeric layers and an internal mechanical layer that extend between mechanical extremities, such as packer end fittings. In one embodiment, the packer is an inflatable packer having an interior bladder, an outer bladder, and a mechanical structural layer between the bladders. The mechanical layer may comprise a plurality of cable layers formed of metal cables positioned in an elastomeric, e.g.

rubber, material. Additionally, the mechanical layer may comprise, or work in cooperation with, a separate anti-extrusion layer deployed through the elastomeric material between mechanical extremities.

Depending on the specific embodiment, various protective features are added to, or used in conjunction with, the packer to reduce the potential for detrimental damage to regions of the elastomeric material and/or portions of the mechanical layer. For example, some embodiments utilize features to prevent contact between components of the mechanical layer and adjacent components of the mechanical layer or packer extremities. Other protective features can be used in addition or as an alternative to reduce the potential for component wear/damage in other areas of the packer. For example, leak paths can be created in a manner that reduces the potential for damage due to voids in the packer structure and friction between packer components. In another example, components are positioned to prevent unwanted extrusion of elastomeric material during curing of the packer. Protective features also can be incorporated into the packer structure to prevent unwanted breakage of the outer elastomeric or seal layer.

In one specific example, at least one protective layer is incorporated into the packer to prevent contact between components, thereby avoiding component wear which could eventually damage the packer. For example, the mechanical layer of an inflatable packer can be formed with two or more cable layers. A protective layer is positioned between the cable layers to prevent contact between the cable layers even if the elastomeric packer material undergoes creep when exposed to the high temperatures and pressures in the downhole, wellbore environment. The protective layer or layers can be formed of an expandable, compliant fiber material, having fibers formed of, for example, aramid, carbon, glass, thermoplastic, or other suitable fiber materials.

The fibers in each protective layer may be set longitudinally, parallel to the axis of the packer, or with an angle compatible with the angle of the cable layers in the packer. For example, if the cables, e.g. steel cables, are set with an angle giving a 10% shortening ratio when the outside diameter of the packer is expanded by 50%, the fibers of this layer may be oriented with an angle relative to the axis of the packer that provides a shortening ratio of between 0% and 10%. By arranging the protective layer in this manner, no tensile damage occurs due to the pulling force associated with an excessive shortening ratio. The use of fiber material in creating the protective layers has been found to create a layer able to inflate and deflate without damage while preventing the cables from touching each other and/or other adjacent components.

Referring generally to FIG. 1, one embodiment of a well system 20 is illustrated as deployed in a wellbore 22. The well system 20 comprises a conveyance 24 employed to deliver downhole at least one packer 26 with one or more of the protective features described below. In many applications, packer 26 is deployed by conveyance 24 in the form of a tubing string, but conveyance 24 may have other forms, including wirelines or slick lines, for other applications. In the embodiment illustrated, conveyance 24 extends downhole from a wellhead 28 positioned at a surface location 30. The packer 26 may cooperate with or be part of a completion 32. Furthermore, packer 26 is designed with one or more features that help preserve the packer and its functionality in a harsh downhole environment. In many downhole environments, packer 26 will be subjected to substantial differential pressures, high temperatures, deleterious fluids, and other detrimental operational factors.

Figure 2:
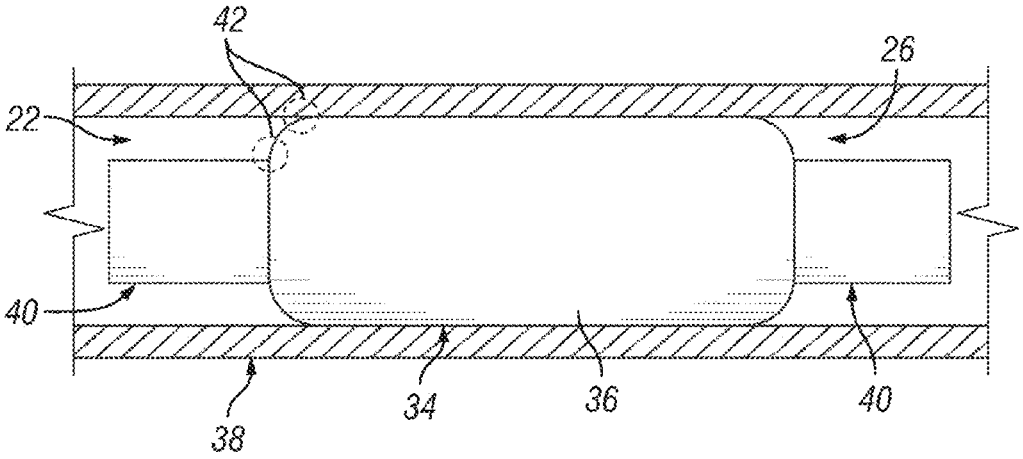
FIG. 2 is a front view of one example of the packer illustrated in FIG. 1 as expanded in the wellbore, according to an embodiment of the present invention.

Referring generally to FIG. 2, one embodiment of packer 26 is illustrated. In this embodiment, packer 26 comprises an expandable portion 34 that comprises an outer elastomeric bladder or seal element 36 designed to seal against a surrounding wellbore wall which may be in the form of a casing 38. The expandable portion 34 is held between a pair of mechanical extremities 40 which may be in the form of metal end fittings. In FIG. 2, packer 26 is illustrated in its expanded configuration in which outer bladder 36 is expanded against the surrounding wellbore wall, thus creating stress regions 42. The stress regions 42 often are located on the low-pressure side of the packer. For example, stress regions 42 can be created proximate the region expandable portion 34 engages mechanical extremity 40 and/or proximate the corner region in which expandable portion 34 first engages the surrounding wellbore wall, e.g. casing 38.

Figure 3:
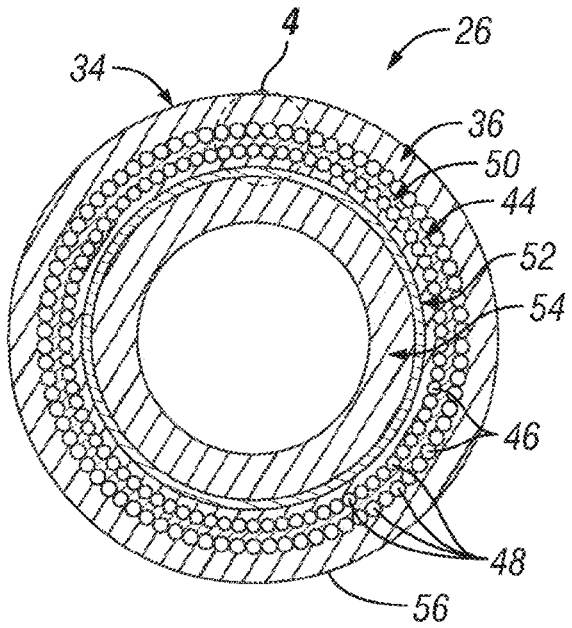
FIG. 3 is a cross-sectional view of the packer illustrated in FIG. 2, according to an embodiment of the present invention.

In FIG. 3, a cross-sectional view of packer 26 (taken through expandable portion 34) is provided to illustrate various components, including protection features, which can be used in the packer. In this specific example, packer 26 comprises outer bladder 36 surrounding a mechanical, structural layer 44. By way of example, mechanical layer 44 may comprise a pair of cable layers 46 formed with a plurality of metal cables 48 disposed in elastomeric material, e.g. rubber, such as the elastomeric material used to form outer bladder 36. The cables 48 of each cable layer 46 can be arranged at an opposite angle with respect to the cables 48 of the adjacent cable layer 46 to create a shortening ratio of each cable layer designed to prevent twisting of the packer when expanded. The cables 48 are set at an angle relative to an axis of packer 26 to ensure homogeneous distribution when the packer 26 is inflated.

Packer 26 also comprises a protective layer 50 that may be deployed between cable layers 46 to prevent contact between cables 48 of adjacent cable layers 46. By way of example, protective layer 50 is formed as a fiber layer having an expandable layer of fibers, such as aramid, carbon, glass, thermoplastic, or other suitable fibers. The fibers may be arranged longitudinally in an orientation parallel to the axis of the packer 26 or at an angle compatible with the angle of the cable layers 46 to avoid an excessive shortening ratio.

The packer also comprises various other components, such as an anti-extrusion layer 52 which may be formed as part of mechanical layer 44 or may be positioned to cooperate with mechanical layer 44. In the embodiment illustrated, anti-extrusion layer 52 is located radially inward of cable layers 46 and radially outward of an inner bladder 54. In this example, inner bladder 54 is formed of an elastomeric material, e.g. rubber, similar to outer bladder 36.

Figure 4:
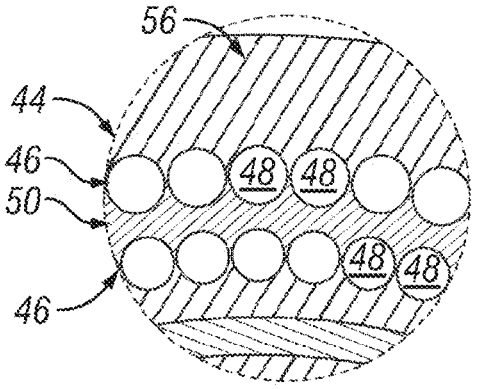
FIG. 4 is a view of an expanded, cross-sectional portion of the packer prior to expansion of the packer against a surrounding wellbore wall, according to an embodiment of the present invention.
Figure 5:
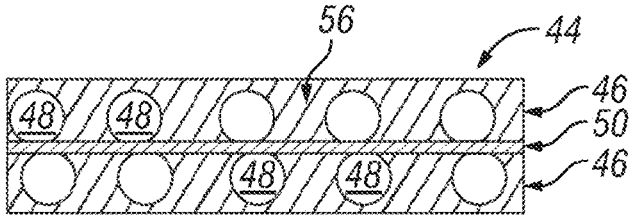
FIG. 5 is a view similar to that of FIG. 4 but showing the cross-sectional portion in an expanded configuration after setting of the packer, according to an embodiment of the present invention.

Prior to expanding packer 26, the cables 48 of cable layers 46 are substantially separated by elastomeric material 56 and protective layer 50, as illustrated in FIG. 4. However, as expandable portion 34 of packer 26 is expanded, the elastomeric material 56 is stretched in a circumferential direction and becomes thinner in a radial direction. This action causes metal cables 48 of adjacent cable layers 46 to move toward each other in a radial direction. Under the heat and pressure of a wellbore environment, the elastomeric material 56 can creep and potentially allow contact between metal cables 48 of adjacent cable layers. However, protective layer 50 prevents such contact, as best illustrated in FIG. 5. Consequently, the packer 26 is protected from undesirable contact, friction, degradation, and potential failure that otherwise could result from contact between cables.

Figure 6:
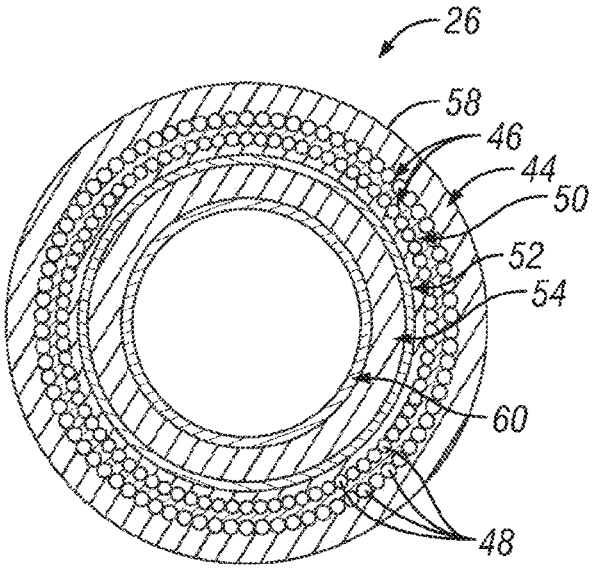
FIG. 6 is a cross-sectional view of the packer taken through one of its mechanical extremities, according to an embodiment of the present invention.
Figure 7:
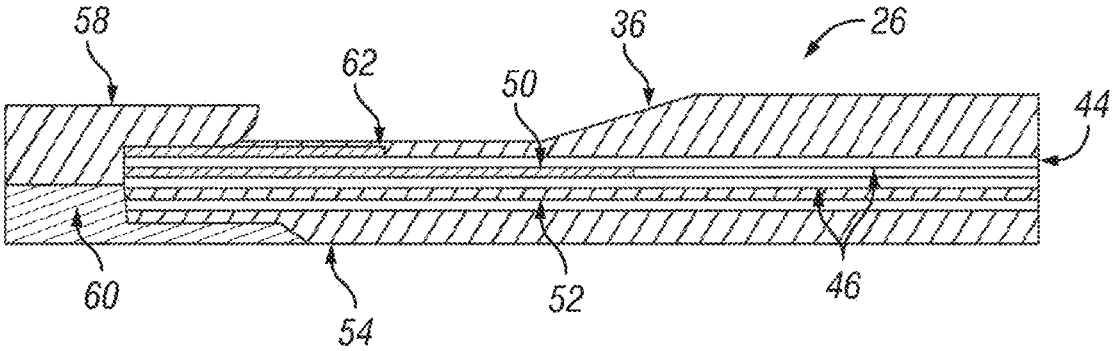
FIG. 7 is an illustration of the elastomeric and mechanical layers extending into a mechanical extremity, according to an embodiment of the present invention.

Referring generally to FIGS. 6 and 7, another example of the use of a protective layer is illustrated. In FIG. 6, a cross-sectional view of packer 26 is taken generally through one of the mechanical extremities 40. As a result, the cross-sectional view illustrates many of the components described with reference to FIG. 3 while also showing components of the mechanical extremity 40, such as an outer skirt 58 and an inner packer nipple 60. Without the use of a protective layer, stresses can induce contact between the radially outer cable layer 46 and the outer mechanical skirt 58 upon inflation of packer 26. Accordingly, another protective layer 62 is disposed between mechanical layer 44 and outer mechanical skirt 58, as illustrated in FIG. 7.

Similar to protective layer 50, protective layer 62 may be formed as a protective fiber layer having fibers arranged, e.g. unidirectional, braided, or other suitable arrangement, to prevent direct contact between the skirt 58 and cables 48 while reducing local stress between the cables and skirt to provide a stronger, longer-lasting packer. In the embodiment illustrated in FIG. 7, protective layers 50 and 62 extend only a portion of the axial distance between mechanical extremities 40. For example, protective layer 62 may be positioned between the outer skirt 58 and the mechanical layer 44, while the protective layer 50 may be positioned through the zone extending from the mechanical extremity to the point where expandable portion 34 of packer 26 contacts the surrounding wellbore wall. However, the protective layers can be designed with different axial lengths and even lengths that extend from one mechanical extremity 40 to the other.

Figure 8:
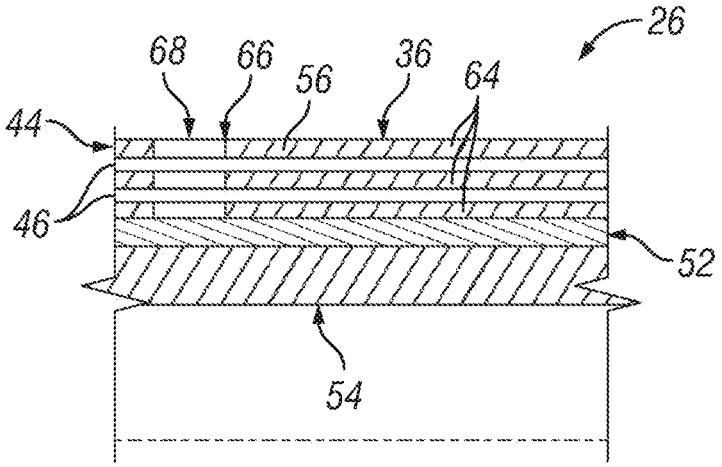
FIG. 8 is a cross-sectional view of a portion of an alternate example of the packer, according to an embodiment of the present invention.

Referring generally to FIG. 8, another protective feature is illustrated to again enhance the life and functionality of the packer. During construction of packers, voids can occur in the packer structure and those voids often have detrimental effects, as discussed above. According to one embodiment of the present invention, these detrimental effects may be limited by utilizing certain materials at specific locations in the packer to render the packer "pressure balanced" with the well environment and/or by "opening" the packer structure to provide a leak path for fluid moving through the packer during run-in. Examples of a material or materials that can be used at the specific locations in the packer include certain liquid materials, e.g. grease materials, or other materials, including non polymerized elastomeric material, e.g. crude buthyl, or non vulcanized rubber. As illustrated in FIG. 8, one or both of these features can be used in packer 26.

In one embodiment, a lubricant material 64, e.g. grease, is used to coat/lubricate certain components that do not need to be bonded together. For example, the lubricant material 64 may be applied to cables 48, anti-extrusion layer 52, and/or other internal components. It should be noted that an extra volume of lubricant material, e.g. grease, also can be contained in a cavity arranged in the packer rubber adjacent to any internal component. The lubricant material 64 helps the packer structure resist detrimental effects resulting from high hydrostatic pressure. In addition or as an alternative to lubricant material 64, a leak path or communication path 66 is established between the well fluid and the packer structure. For example, leak path 66 may be established in a generally radial direction through the elastomeric material 56, e.g. rubber and/or Teflon®, surrounding cable layers 46. The leak path 66 may be established by positioning an insert component 68 through the elastomeric material 56. Depending on the environment and the type of material 56 used in packer 26, the insert may be formed from Teflon®, a suitable high temperature thermoplastic, aramid, carbon, or other suitable materials that create a leak path along the interface between the insert and the surrounding material 56. In one example, the material selected for insert 68 is incompatible with elastomeric material 56 to prevent damage during packer expansion. In other words, the material of insert 68 does not bond with material 56. This also ensures the leak path does not plug when the packer 26 is deformed.

Figure 9:
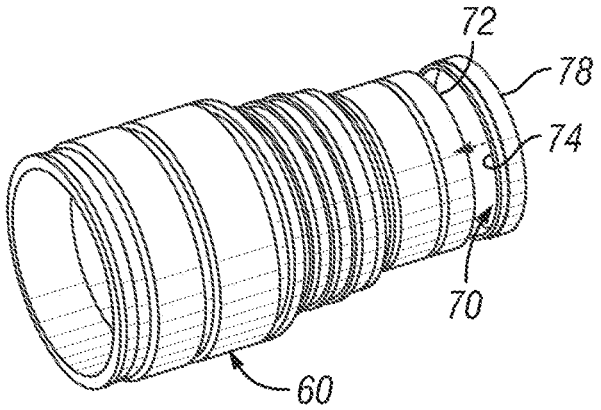
FIG. 9 is an orthogonal view of a packer nipple to which an extrusion prevention ring is being applied, according to an embodiment of the present invention.
Figure 10:
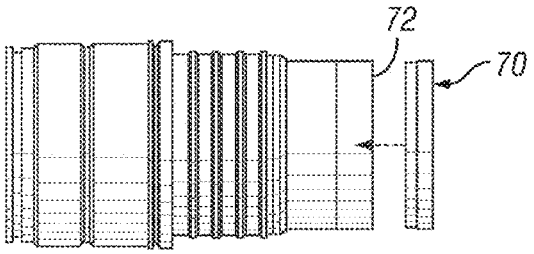
FIG. 10 is a front view of a packer nipple to which an extrusion prevention ring is being applied, according to an embodiment of the present invention.
Figure 11:
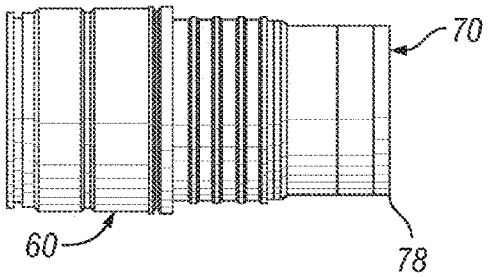
FIG. 11 is a front view of a packer nipple with an extrusion prevention ring, according to an embodiment of the present invention.
Figure 12:
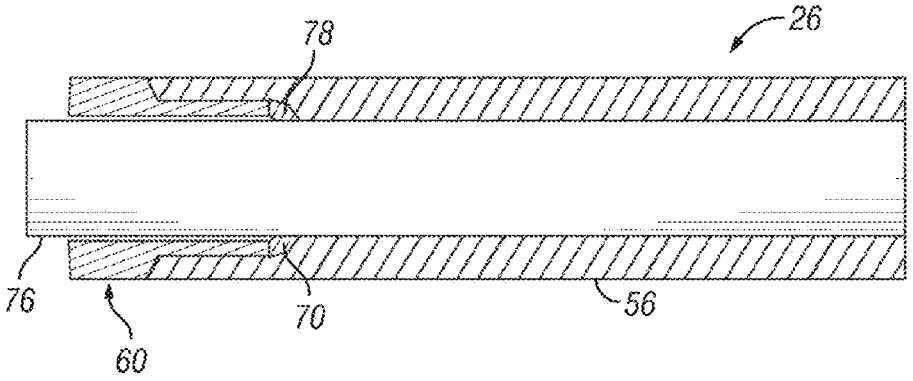
FIG. 12 is a view illustrating formation of a packer over a manufacturing mandrel, according to an embodiment of the present invention.

In another embodiment, packer 26 is protected by preventing extrusion of elastomeric material 56 along an interior of each packer nipple 60 during packer construction. As illustrated in FIGS. 9 and 10, an extrusion prevention ring 70 is selected for use in combination with each inner packer nipple 60. The extrusion prevention ring 70 is moved into abutment with an axially inner end 72 of the packer nipple 60, as further illustrated in FIG. 11. The extrusion prevention ring 70 has an inner diameter 74 selected to fit snugly around a manufacturing mandrel 76 to prevent extrusion of elastomeric material 56 between nipple 60 and manufacturing mandrel 76 during curing of the packer, as illustrated in FIG. 12. The extrusion prevention ring 70 also may include an axially inner tapered surface 78 that helps bias ring 70 against manufacturing mandrel 76 when pressure is applied during the curing process.

Referring again to FIG. 12, manufacture of packer 26 involves sliding each combined nipple 60 and extrusion prevention ring 70 onto respective ends of the manufacturing mandrel 76. The elastomeric material 56, e.g. inner bladder 54, is applied over extrusion prevention rings 70 and over at least a portion of each packer nipple 60. Application of material 56 can be via rubber injection, compression molding, hand setting of a rubber band, or by other suitable manufacturing techniques. When material 56 is cured, pressure is applied to minimize voids within the material and to ensure bonding efficiency. The extrusion prevention rings 70 prevent undesirable extrusion/creep of the material along an interior of the packer nipples 60. By way of example, extrusion prevention rings 70 may be formed from a polymer material or other suitable materials, including Teflon®, polyamide, and fluoroelastomer (FKM). Often, the material is selected so as to be incompatible with material 56 to avoid sticking and stress generation during use, e.g. inflation, of the packer.

In another embodiment, the outer layer/bladder 36 is designed with features to prevent breakage of the material. Breakage of the elastomeric material can create a variety of difficulties, including difficulty in extraction of the packer and increased potential for contact between internal packer components, such as cables 48.

The outer layer 36 often is relied on to perform a variety of functions, including insuring that a seal is created between the wellbore and packer when the packer is inflated. The outer layer also must mitigate well irregularities while limiting excessive structural deformation. Furthermore, the material selected for outer layer 36 should be able to consistently form the desired seals during manufacturing and also provide adequate protection of internal packer components against the harsh elements found in a wellbore environment. In other applications, the outer layer is used to avoid mud migration within the packer structure while avoiding packer failure during inflation and deflation. The outer bladder layer 36 also can be utilized in facilitating deflation of the packer. Accordingly, maintaining the integrity of the outer bladder layer 36 is important in many well applications.

Figure 13:
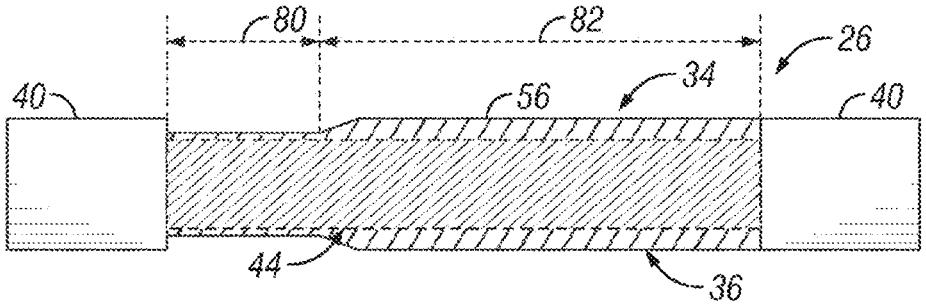
FIG. 13 is a front view of another example of the packer, according to an alternate embodiment of the present invention.
Figure 14:
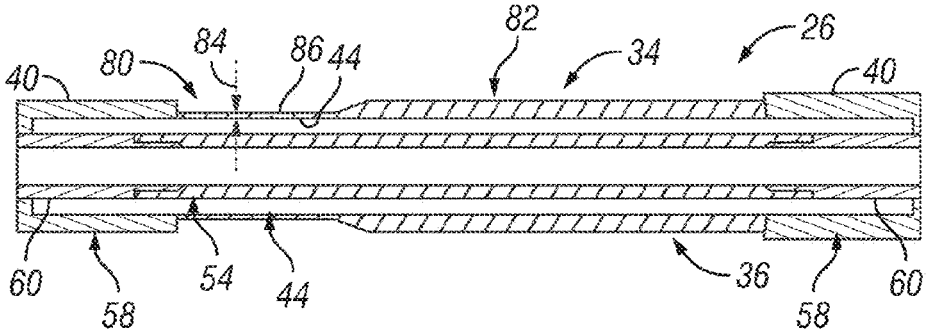
FIG. 14 is a cross-sectional view of the packer illustrated in FIG. 13 taken generally along the axis of the packer, according to an embodiment of the present invention.

As illustrated in FIG. 13, one embodiment of packer 26 utilizes a thin skin section 80 and a thick skin section 82 along outer bladder 36. The thin skin section 80 is positioned proximate at least one of the mechanical extremities 40 and extends through a region susceptible to outer bladder breakage. In one embodiment, the thin skin section 80 has a radial thickness 84 of one millimeter or less extending from mechanical layer 44 to a radially outer surface 86, as illustrated in FIG. 14. When the packer 26 is expanded and a pressure differential is applied, the elastomeric material of thin skin section 80 is too thin to break. As a result, thin skin section 80 maintains protection over mechanical layer 44 and its components, e.g. cables 48.

The thick skin section 82 utilizes elastomeric material 56 with a substantially greater thickness in locations where breakage of the outer bladder layer is not expected. In these regions, the thickness of the skin can be selected to provide resiliency that facilitates deflation of the packer. The thickness of skin in thick skin section 82 also should enable good pressure differential sealing even if some surface damage occurs during running-in. The thickness also is selected to protect the internal packer structure against damage that can otherwise be caused by wellbore irregularity and roughness.

Figure 15:
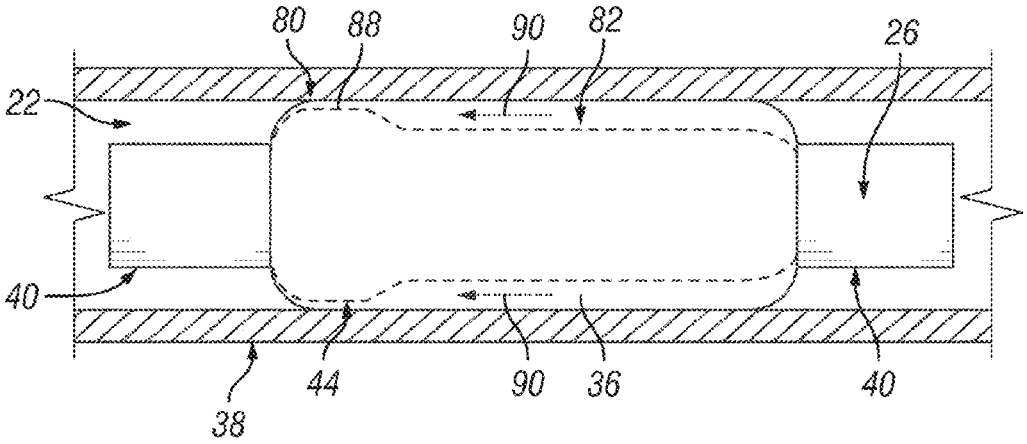
FIG. 15 is a front view of the packer illustrated in FIG. 13 but in an expanded configuration, according to an embodiment of the present invention.

In some embodiments, the mechanical layer 44 is designed to flex to a greater diameter in thin skin section 80, as illustrated in FIG. 15. The additional expansion of mechanical layer 44 and thin skin section 80 serves as an abutment 88 that prevents movement/creep of elastomeric material from the thick skin section 82. The abutment 88 serves as a mechanical structure backup that prevents unwanted distortion of the packer even under substantial heat and pressure differentials that bias the material 56 toward thin skin section 80, as represented by arrows 90.

Also, in any of the embodiments described above where a component is described as being formed of rubber or comprising rubber, the rubber may include an oil resistant rubber, such as NBR (Nitrile Butadiene Rubber), HNBR (Hydrogenated Nitrile Butadiene Rubber) and/or FKM (Fluoroelastomers). In a specific example, the rubber may be a high percentage acrylonytrile HNBR rubber, such as an HNBR rubber having a percentage of acrylonytrile in the range of approximately 21 to approximately 49%. Components suitable for the rubbers described in this paragraph include, but are not limited to, elastomeric material 56, outer bladder 36 and inner bladder 54.

As described above, well system 20 and packer 26 may be constructed in a variety of configurations for use in many environments and applications. The packer 26 may be constructed from many types of materials and with components positioned in various arrangements. Additionally, individual packer protection features or various combinations of packer protection features can be utilized in the individual packer. Depending on the packer construction and the environment in which the packer is to be used, the size, materials and configuration of the protection features can be adjusted.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of forming a downhole inflatable packer, comprising:

providing a packer nipple;

locating an extrusion prevention ring abutting an inner surface of the packer nipple at an axial end of the packer nipple;

positioning an elastomeric packer layer over the extrusion prevention ring and at least a portion of the packer nipple; and curing the elastomeric packer layer.

2. The method as recited in claim 1, wherein locating the extrusion prevention ring comprises locating a polymer extrusion prevention ring.

3. The method as recited in claim 1, further comprising selecting an extrusion prevention ring material that is incompatible with the elastomeric packer layer.

4. The method as recited in claim 1, wherein curing comprises applying pressure to minimize voids in the downhole inflatable packer.

5. The method as recited in claim 1, wherein locating comprises locating an extrusion prevention ring adjacent each packer nipple of a pair of packer nipples.

6. The method as recited in claim 1, wherein the extrusion prevention ring is configured to prevent extrusion of the elastomeric packer layer along the inner surface of the packer nipple during formation of the downhole inflatable packer.

7. The method as recited in claim 1, comprising providing the packer nipple on a manufacturing mandrel, wherein the extrusion prevention ring comprises an inner diameter selected to prevent extrusion of the elastomeric packer layer between the packer nipple and the manufacturing mandrel during the curing of the elastomeric packer layer.

8. The method as recited in claim 7, wherein the extrusion prevention ring comprises an axially inner tapered surface configured to bias the extrusion prevention ring against the manufacturing mandrel during the curing of the elastomeric packer layer.

9. The method as recited in claim 1, wherein the extrusion prevention ring comprises a first ring portion with a first diameter and a second ring portion with a second diameter less than the first diameter, the inner surface of the packer nipple comprises a third diameter greater than the second diameter and less than the first diameter such that the second ring portion fits within the inner surface of the packer nipple but the first ring portion does not fit within the inner surface of the packer nipple.

* * * * *